US009698514B2

(12) United States Patent
Tanikawa et al.

(10) Patent No.: US 9,698,514 B2
(45) Date of Patent: Jul. 4, 2017

(54) CONNECTOR

(75) Inventors: Naotaka Tanikawa, Yokkaichi (JP); Yuujirou Imai, Yokkaichi (JP)

(73) Assignee: Sumitomo Wiring Systems, Ltd., Yokkaichi, Mie (JP)

( * ) Notice: Subject to any disclaimer, the term of this patent is extended or adjusted under 35 U.S.C. 154(b) by 485 days.

(21) Appl. No.: 14/357,044

(22) PCT Filed: Jul. 5, 2012

(86) PCT No.: PCT/JP2012/067185

§ 371 (c)(1),
(2), (4) Date: May 8, 2014

(87) PCT Pub. No.: WO2013/069337

PCT Pub. Date: May 16, 2013

(65) Prior Publication Data

US 2014/0301780 A1 Oct. 9, 2014

(30) Foreign Application Priority Data

Nov. 9, 2011 (JP) ..... 2011-245528

(51) Int. Cl.
*H01R 13/422* (2006.01)
*H01R 13/42* (2006.01)
*H01R 13/436* (2006.01)

(52) U.S. Cl.
CPC ..... *H01R 13/42* (2013.01); *H01R 13/4362* (2013.01); *H01R 13/4223* (2013.01); *Y10T 403/60* (2015.01); *Y10T 403/7075* (2015.01)

(58) Field of Classification Search
CPC .. H01R 13/42; H01R 13/422; H01R 13/4223; H01R 13/4361; H01R 13/4362;
(Continued)

(56) References Cited

U.S. PATENT DOCUMENTS 6,780,070 B2 * 8/2004 Ishikawa ..... H01R 13/4362 439/752

FOREIGN PATENT DOCUMENTS

JP 2005-222758 8/2005
JP 2005222758 8/2005
(Continued)

OTHER PUBLICATIONS

European Patent Appl. No. 12 847 082.0—Extended Search Report Issued May 29, 2015.

*Primary Examiner* — Josh Skroupa
(74) *Attorney, Agent, or Firm* — Gerald E. Hespos; Michael J. Porco; Matthew T. Hespos

(57) ABSTRACT

A connector (10) includes a female housing (20) for accommodating female terminals (24) and a retainer (40) mountable in female housing (20). The retainer (40) includes a retaining portion (41) that retains the female terminals (24) by being inserted into a retainer mounting hole (27) in the female housing (20). Locks (46) are adjacent to the retaining portion (41) in a direction intersecting an inserting direction of the retaining portion (41) while standing up from bases (45) integral to the retaining portion (41). The locks (46) resiliently deform by moving onto partial locking projections (30) and full locking projections (31) formed in the female housing (20), and resiliently restore to engage the partial locking projections (30) and the full locking projections (31). The lock pieces (46) are separated from the retaining portion (41).

6 Claims, 9 Drawing Sheets

(58) Field of Classification Search
CPC ..... H01R 13/4364; H01R 13/4365; H01R 13/4367; H01R 13/4368; H01R 13/62; H01R 13/627; H01R 13/6273; Y10T 403/16; Y10T 403/60; Y10T 403/7075
USPC ..... 403/16, 326, 375; 439/353, 354, 358, 439/744
See application file for complete search history.

(56) References Cited

FOREIGN PATENT DOCUMENTS

| | | | | |
|---|---|---|---|---|
| JP | 2006100237 | | 4/2006 | |
| JP | 2008153018 | | 7/2008 | |
| JP | 2010-062076 | | 3/2010 | |
| JP | 2010062076 | | 3/2010 | |
| JP | 2010211934 A | * | 9/2010 | ..... H01R 13/42 |

* cited by examiner

CONNECTOR

BACKGROUND

1. Field of the Invention

The present invention relates to a connector.

2. Description of the Related Art

Conventionally, a connector provided with a retainer made of synthetic resin for preventing a terminal fitting accommodated into a connector housing from behind from coming out rearward is known from Japanese Unexamined Patent Publication No. 2005-222758 below.

This retainer includes a retaining portion to be inserted into a retainer inserting portion open on a bottom part of the connector housing to retain the terminal fitting from behind, and a pair of lock pieces standing upward from opposite widthwise end sides of the retaining portion.

The lock pieces extend further forward than the retaining portion along side surfaces located on opposite widthwise sides of the connector housing and are integrally formed to the retaining portion. A locking claw engageable with a lock portion projecting before the retainer inserting portion in the connector housing is formed on the upper end edge of each lock piece. When the retaining portion is inserted into the retainer inserting portion, the lock pieces move onto the lock portions to be resiliently widened away from each other and are resiliently restored to engage the locking claws and the lock portions and fix the retainer to the connector housing.

However, since the lock pieces are formed before the retaining portion and integrally to the retaining portion according to the above connector, the lock pieces are resiliently widened toward oblique front upper sides with the retaining portion as a support point and assume such postures as to be resiliently deformed obliquely forward different from proper postures with respect to the lock portions when the lock pieces move onto the lock portions, with the result that the lock pieces and the lock portions are held in point contact. Thus, when the retaining portion is inserted into or withdrawn from the retainer inserting portion, point contact parts of the lock pieces and the lock portions are abraded to make the engaged state of the locking claws and the lock portions unstable.

SUMMARY OF THE INVENTION

The present invention was completed based on the above situation and an object thereof is to resiliently deform a lock piece in a proper posture.

To achieve the above object, the present invention is directed to a connector, including a connector housing for accommodating a terminal fitting and a retainer mountable into the connector housing, wherein the retainer includes a retaining portion which retains the terminal fitting by being inserted into a retainer mounting hole provided in the connector housing, and a lock piece which is arranged adjacent to the retaining portion in a direction intersecting with an inserting direction of the retaining portion while standing up from a base body integrally formed to the retaining portion, resiliently deformed with a part coupled to the base body as a support point by moving onto a lock portion formed in the connector housing, and resiliently restored to be engaged with the lock portion; and the lock piece is separated from the retaining portion.

According to the thus configured connector, since the lock piece and the retaining portion are separated, the lock piece can be independently resiliently deformed without being affected by the retaining portion. This can prevent the resilient deformation of the lock piece in a direction different from that in a proper posture with respect to the lock portion and suppress the abrasion of the lock piece and the lock portion. Consequently, an engaged state of the lock portion and the lock piece can be made stable.

A slit may be formed at a position where the retaining portion and the lock piece are adjacent to each other.

According to such a configuration, the lock piece can be resiliently deformed without interfering with the retaining portion. This can more easily resiliently deform the lock piece to have the proper posture as compared with the case where the retaining portion and the lock piece are formed in close contact with each other.

According to the present invention, it is possible to resiliently deform a lock piece in a proper posture.

DETAILED DESCRIPTION OF THE PREFERRED EMBODIMENTS

An embodiment of the present invention is described with reference to FIGS. 1 to 10.

In this embodiment is illustrated a connector 10 provided with a female housing (an example of a "connector housing" of the present invention) 20 made of synthetic resin and fittable into an unillustrated accommodating portion of a male housing, and a retainer 40 made of synthetic resin and configured to retain female terminals (an example of a "terminal fitting" of the present invention) 24 to be accommodated into the female housing 20.

Figure 1:
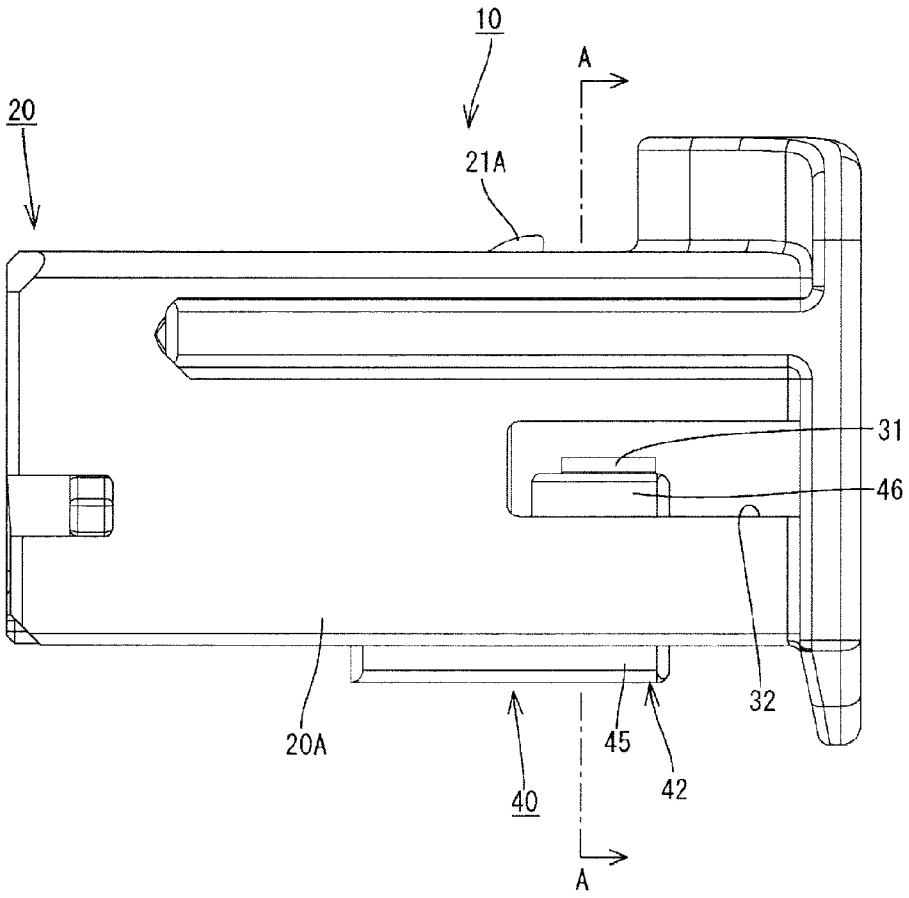
FIG. 1 is a side view showing a state where a retainer is held at a partial locking position in a female housing.
Figure 3:
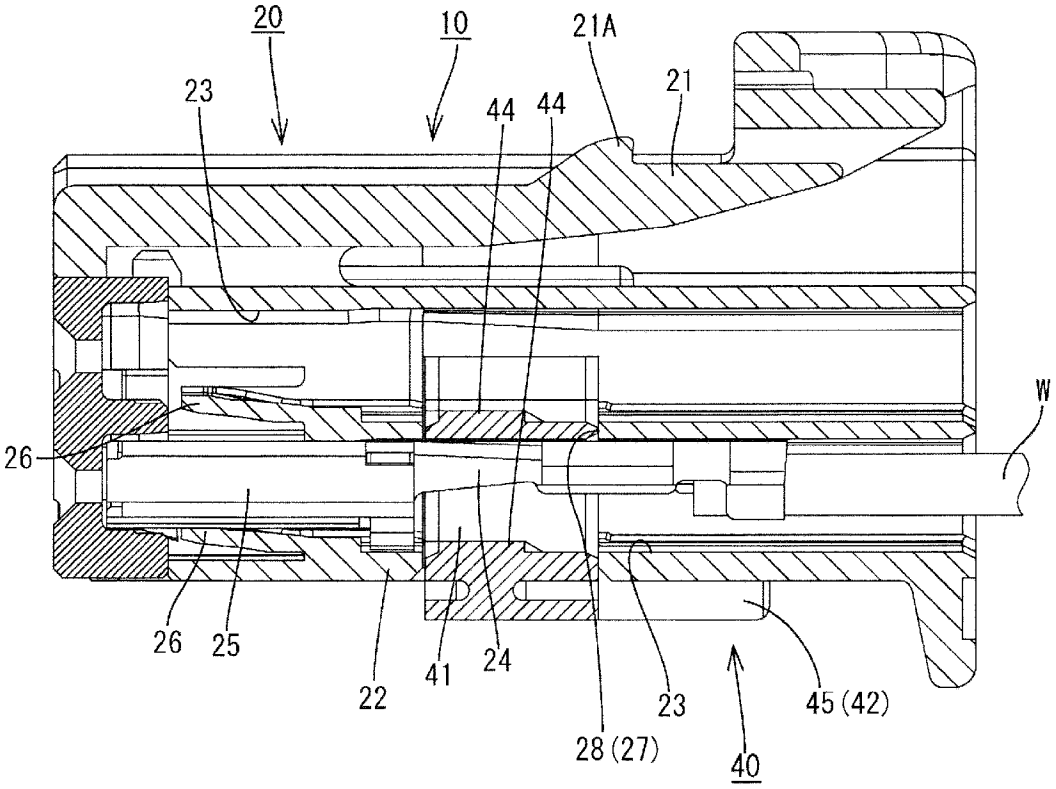
FIG. 3 is a longitudinal section showing the state where the retainer is held at the partial locking position in the female housing.

As shown in FIGS. 1 and 3, the female housing 20 is roughly in the form of a block long in forward and rearward directions. A lock arm 21 cantilevered rearward from a front side toward a rear side is formed in an upper part of the female housing 20. The lock arm 21 is formed to be vertically resiliently deformable, and a locking projection 21A capable of locking an unillustrated locked portion formed in the accommodating portion of the male housing is formed on the upper surface of the lock arm 21. When the female housing 20 is fitted into the accommodating portion of the male housing, the lock arm 21 is resiliently deformed. When the female housing 20 is properly fitted into the accommodating portion of the male housing, the lock arm 21 is resiliently restored, whereby the locking projection 21A locks the locked portion to hold the female housing 20 and the male housing in a connected state.

Figure 4:
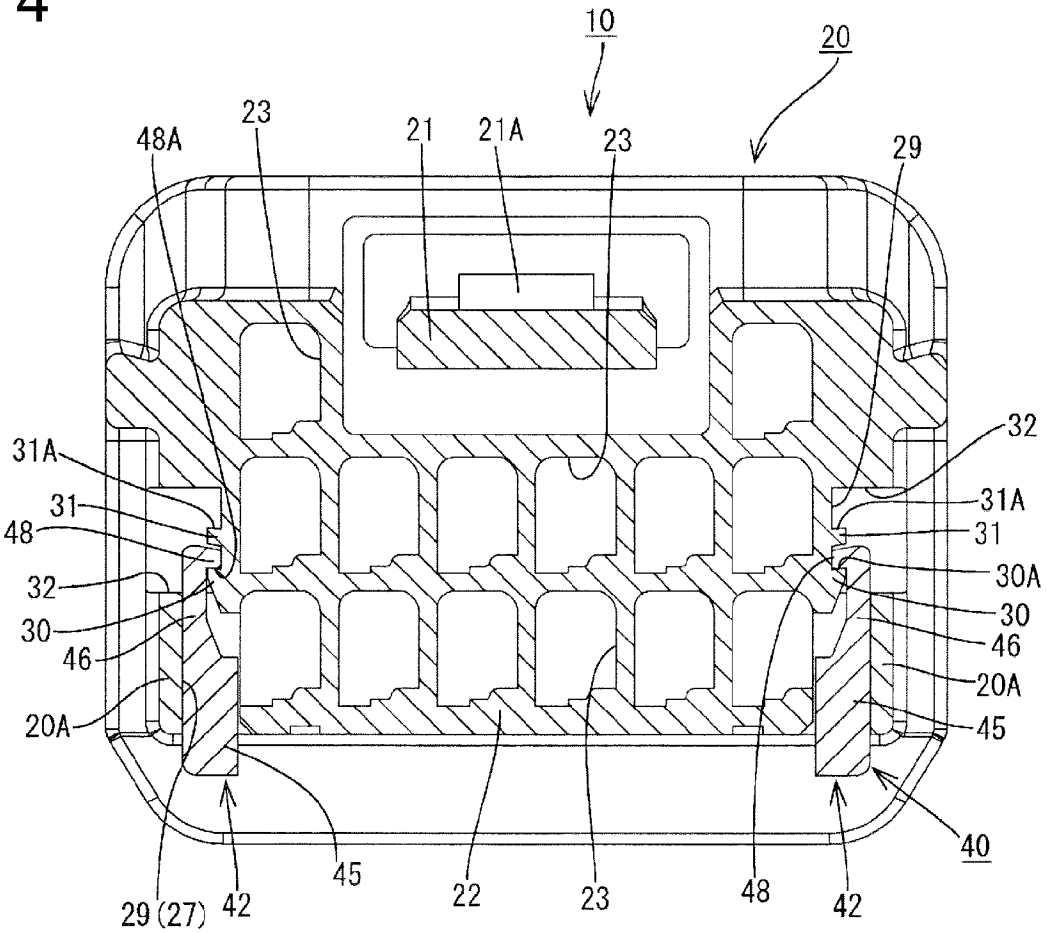
FIG. 4 is a section along A-A of FIG. 1.

As shown in FIGS. 3 and 4, a terminal accommodating portion 22 slightly narrower than the width of the female housing 20 is formed in the female housing 20. The terminal accommodating portion 22 includes a plurality of cavities 23 penetrating in forward and rearward directions. The plurality of cavities 23 are arranged side by side in vertical and width directions as shown in FIG. 4 and the female terminals 24 connected to ends of wires W can be accommodated into the cavities 23 from behind as shown in FIG. 3.

A front part of the female terminal 24 is formed into a connecting portion 25 in the form of a rectangular tube and a rear part thereof is crimped to the end of the wire W. The female terminal 24 is retained in the cavity 23 by the connecting portion 25 being locked by a locking lance 26 cantilevered forward from an inner wall of the cavity 23 from behind.

When the female housing 20 and the male housing are properly connected, unillustrated male terminals held in the accommodating portion of the male housing enter the connecting portions 25 of the female terminals 24, whereby the female terminals 24 and the male terminals are electrically conductively connected.

Figure 2:
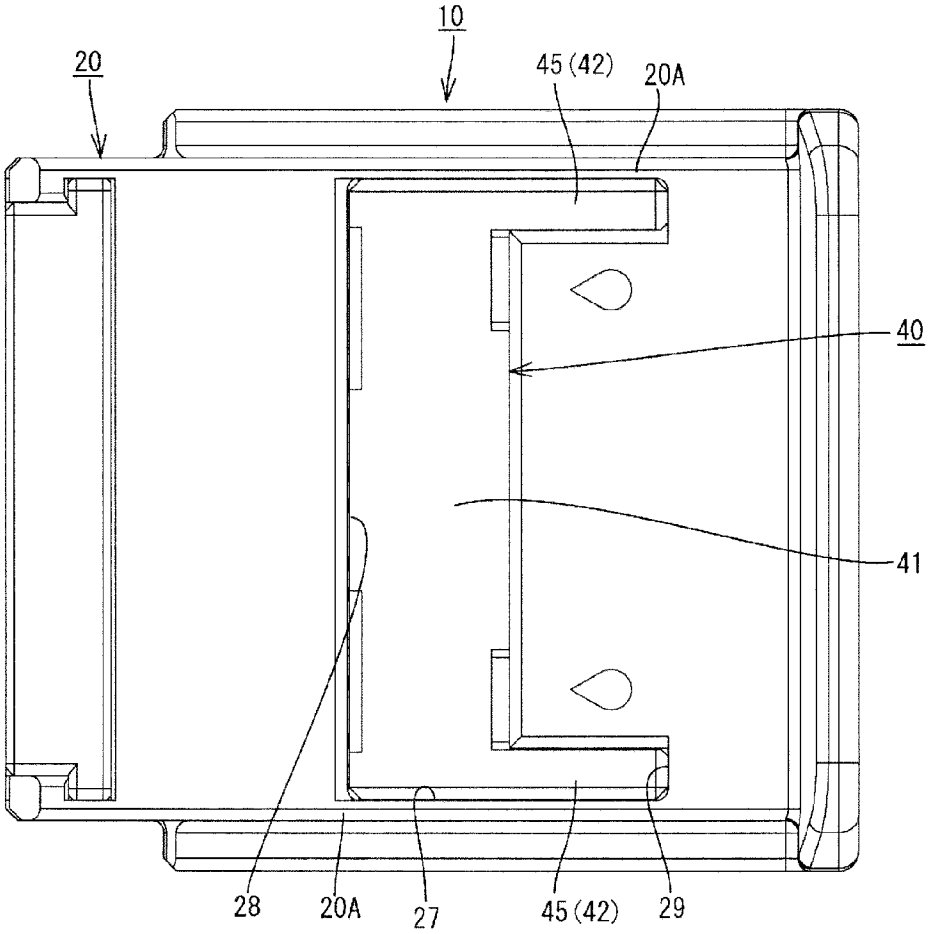
FIG. 2 is bottom view showing the state where the retainer is held at the partial locking position in the female housing.

As shown in FIGS. 2 and 3, a retainer mounting hole 27 is formed in a substantially central part of the bottom surface of the female housing 20 in forward and rearward directions. An opening of the retainer mounting hole 27 is formed into a substantially U shape, and the retainer mounting hole 27 is composed of a retaining portion accommodating portion 28 long in the width direction and a pair of lock piece accommodating portions 29 long in forward and rearward directions and extending rearward from opposite end parts of the retaining portion accommodating portion 28.

As shown in FIG. 3, the retaining portion accommodating portion 28 is recessed upward from the bottom surface of the female housing 20, and an inner space of the retaining portion accommodating portion 28 communicates with each cavity 23 in the terminal accommodating portion 22.

The pair of lock piece accommodating portions 29 are formed inwardly of side walls 20A located on opposite widthwise end parts of the female housing 20. Specifically, the lock piece accommodating portions 29 are respectively arranged between the terminal accommodating portion 22 and the both side walls 20A of the female housing 20 and formed along the side surfaces of the female housing 20. Further, the lock piece accommodating portions 29 are recessed upward from the bottom surface of the female housing 20 similarly to the retaining portion accommodating portion 28.

As shown in FIGS. 1 and 4, partial locking projections (an example of a "lock portion" of the present invention) 30 for holding the retainer 40 to be described later at a partial locking position and full locking projections (an example of the "lock portion" of the present invention) 31 for holding the retainer 40 at a full locking position are respectively formed on widthwise inner surfaces of the lock piece accommodating portions 29 near the terminal accommodating portion 22. Both the partial locking projections 30 and the full locking projections 31 are formed to project outward in the width direction from the inner surfaces near the terminal accommodating portion 22 and extend in forward and rearward directions.

The partial locking projection 30 includes, on its top, a partial locking surface 30A extending outward in the width direction from the inner surface near the terminal accommodating portion 22, extends slightly downward from the outer end of the partial locking surface 30A and then comes closer to the terminal accommodating portion 22 as it extends downward.

The full locking projection 31 is located on a further back side of the lock piece accommodating portion 29 than the partial locking projection 30, i.e. above the partial locking projection 30, and formed to have a substantially rectangular cross-section and include a full locking surface 31A extending in the width direction from the inner surface near the terminal accommodating portion 22.

On the other hand, the retainer 40 includes a retaining portion 41 fittable into the retaining portion accommodating portion 28, and a pair of lock plates 42 respectively fittable into the pair of lock piece accommodating portions 29. Note that forward and rearward directions in the description of the configuration of the retainer 40 are based on directions of arrows in FIG. 5 and a front side is denoted by F and a rear side is denoted by R.

Figure 7:
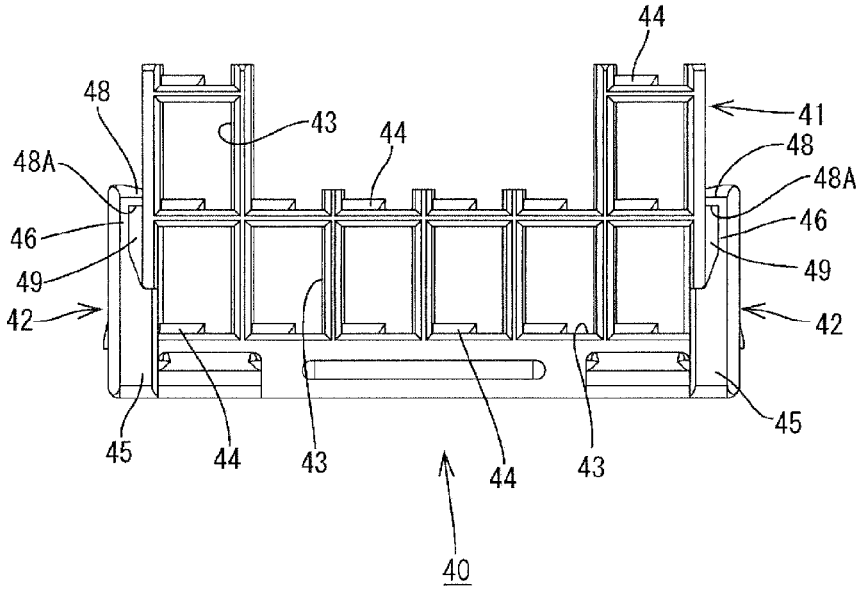
FIG. 7 is a rear view of the retainer.

As shown in FIG. 7, the retaining portion 41 is substantially U-shaped in a rear view and formed into a lattice shape long in the width direction by a plurality of substantially rectangular terminal insertion holes 43 penetrating in forward and rearward directions being formed in the vertical and width directions.

A plurality of terminal locking portions 44 for locking the connecting portions 25 of the female terminals 24 inserted into the cavities 23 of the female housing 20 from behind are formed in correspondence with the respective cavities 23 on the bottom surfaces of the respective terminal insertion holes 43 and the upper surface of the retaining portion 41.

Figure 8:
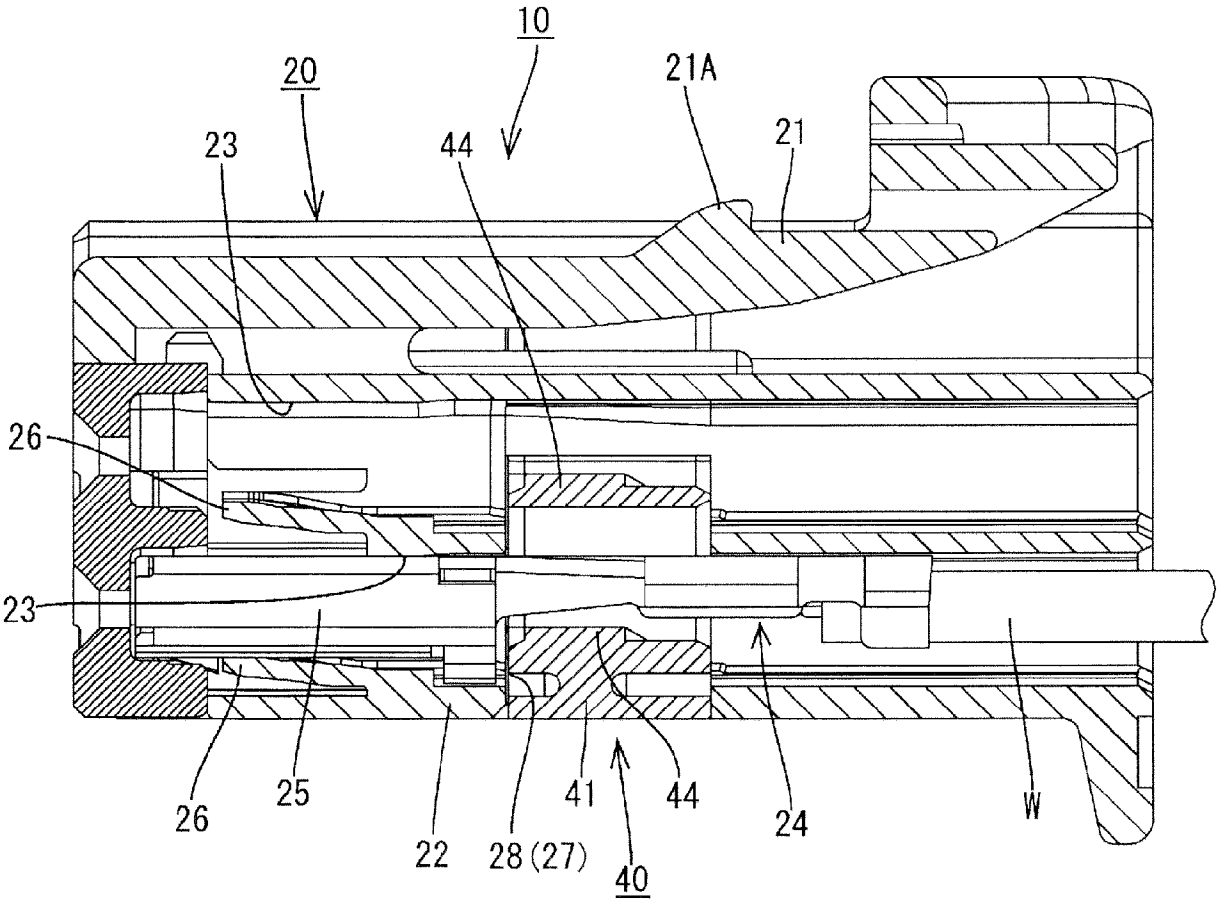
FIG. 8 is a longitudinal section showing a state where the retainer is held at a full locking position in the female housing.

Further, the retaining portion 41 locks the female terminals 24 from behind by the terminal locking portions 44 projecting into the cavities 23 and is movable between the full locking position (see FIG. 8) where the female terminals 24 are retained in the cavities 23 and the partial locking position (see FIG. 3) where the terminal locking portions 44 are retracted from the cavities 23 to permit the insertion and withdrawal of the female terminals 24 into and from the cavities 23. This causes the connecting portions 25 of the female terminals 24 to be locked by the terminal locking portions 44 from behind and the female terminals 24 to be doubly locked by the locking lances 26 and the terminal locking portions 44 as shown in FIG. 8 when the retaining portion 41 is fitted up to the full locking position with the female terminals 24 accommodated in the cavities 23.

Figure 5:
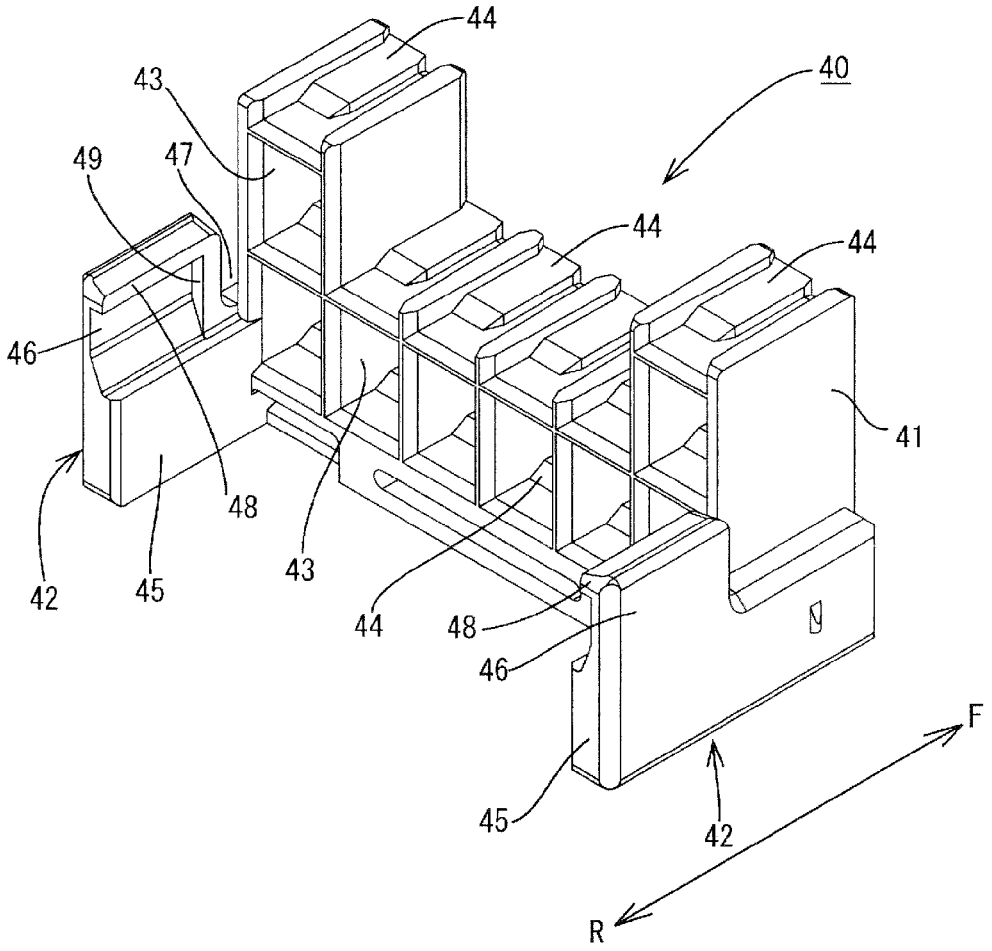
FIG. 5 is a perspective view of the retainer when viewed from behind.
Figure 6:
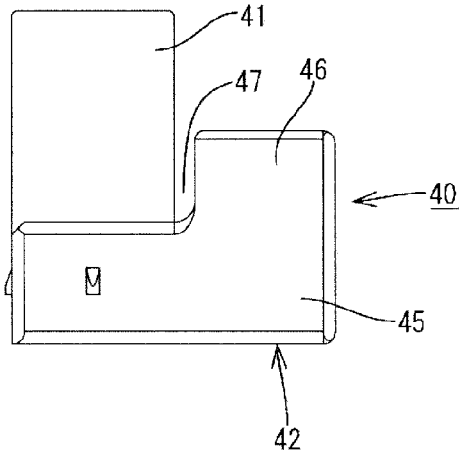
FIG. 6 is a side view of the retainer.

As shown in FIGS. 5 and 6, the pair of lock plates 42 are in the form of flat plates and formed behind and adjacent to the retaining portion 41. Each lock plate 42 includes a base body 45 extending rearward from one of opposite widthwise end parts of the retaining portion 41 and a lock piece 46 standing upward from the base body 45. Note that, in FIG. 5, a left front side of the plane is a rear side and a right back side thereof is a front side.

The both base bodies 45 are in the form of rectangular flat plates and integrally formed to a rear end part of the retaining portion 41 while facing each other.

The lock pieces 46 are in the form of rectangular flat plates thinner than the base bodies 45. The lock piece 46 is integrally formed to a widthwise outer side of the upper end edge of the base body 45 and resiliently deformable outward in the width direction with a base end part coupled to the base body 45 as a support point. Further, a vertically extending slit 47 is formed at a position where the lock piece 46 and the retaining portion 41 are adjacent to each other, whereby the lock piece 46 and the retaining portion 41 are separated. This enables the lock piece 46 to be independently resiliently deformed without interfering with the retaining portion 41.

Lock claws 48 engageable with the partial locking projections 30 and the full locking projections 31 in the lock piece accommodating portions 29 are formed on the upper end edges of the lock pieces 46. The locking claw 48 is formed to project inward in the width direction from the upper end edge of the lock piece 46, and a lock-side locking surface 48A, which is the lower surface of the locking claw 48, can be engaged with the partial locking surface 30A of the partial locking projection 30 from above to hold the retaining portion 41 at the partial locking position when the retaining portion 41 is arranged at the partial locking position. Further, the lock-side locking surface 48A can be engaged with the full locking surface 31A of the full locking projection 31 from above to hold the retaining portion 41 at the full locking position when the retaining portion 41 is arranged at the full locking position.

Further, the locking claws 48 extend in forward and rearward directions, and the length thereof in forward and rearward directions is set to be substantially equal to those of the partial locking projections 30 and the full locking projections 31 in forward and rearward directions. This enables the retaining portion 41 to be reliably held at the partial locking position or the full locking position by bringing the lock-side locking surfaces 48A and the partial locking surfaces 30A or the full locking surfaces 31A into surface contact in forward and rearward directions at the partial locking position and the full locking position.

Further, a reinforcing portion 49 projecting inward in the width direction is formed on a lateral edge part of the lock piece 46 adjacent to the retaining portion 41. The reinforcing portion 49 is integrally formed to the locking claw 48 and suppresses settling of the lock piece 46 associated with resilient deformation.

On the other hand, through holes 32 having a substantially rectangular cross-section and long in forward and rearward directions are respectively formed in the opposite side walls 20A of the female housing 20. The through holes 32 are formed to penetrate through the side walls 20A in the width direction in substantially vertical central parts of the side walls 20A of the female housing 20. Further, the through holes 32 are arranged at such positions that peripheral parts of the partial locking projections 30 and the full locking positions 31 can be visually confirmed from widthwise outer sides through the through holes 32. Thus, upper end parts of the lock pieces 46 can be visually confirmed through the through holes 32 with the retaining portion 41 held at the partial locking position, and parts of the lock pieces 46 above the base end parts can be visually confirmed through the through holes 32 with the retaining portion 41 held at the full locking position.

Specifically, the base bodies 45 and the base end parts of the lock pieces 46 are arranged inwardly of parts of the side walls 20A located below the through holes 32 both at the partial locking position and the full locking position. This can suppress the contact of other members with the base bodies 45 and the base end parts of the lock pieces 46. Thus, the damage and deformation of the lock pieces 46 due to contact with other members can be suppressed as compared with the case where the lock pieces 46 are completely exposed to the widthwise outer sides.

Further, parts of the side walls 20A vertically adjacent to each other across the through holes 32 are continuously formed in forward and rearward directions, which is a connecting direction of the female housing 20. Specifically, there is no step between the parts of the side walls 20A located above and below the through holes 32, and a connecting operation can be smoothly performed without the opening edge part of the accommodating portion and the side walls 20A of the female housing 20 being caught by each other even if the female housing 20 is fitted into the accommodating portion of the male housing in a posture slightly inclined in the width direction.

Further, inner spaces of the through holes 32 serve as deformation spaces allowing the resilient deformation of the lock pieces 46. Thus, in the process of moving the retaining portion 41 from the partial locking position to the full locking position, the locking claws 48 move onto the full locking projections 31 and the lock pieces 46 are resiliently deformed outward in the width direction, whereby the entrance of tip parts of the lock pieces 46 into the inner spaces (deformation spaces) of the through holes 32 is permitted. When the locking claws 48 move over the full locking projections 31, the lock pieces 46 are resiliently restored and the lock-side locking surfaces 48A of the locking claws 48 and the full locking surfaces 31A of the full locking projections 31 are engaged, thereby holding the retaining portion 41 at the full locking position.

Specifically, by accommodating the tip parts of the lock pieces 46 into the inner spaces (deformation spaces) of the through holes 32, the lock pieces 46 can be resiliently deformed without providing deformation spaces stretching in the width direction between the side walls 20A of the female housing 20 and the lock piece accommodating portions 29. This can prevent the enlargement of the female housing 20 as compared with the case where the deformation spaces for the lock pieces 46 are separately formed in the female housing 20.

Further, when the lock claws 48 move onto the full locking projections 31 and the lock pieces 46 start being resiliently deformed outward in the width direction, the lock pieces 46 are held in contact with the parts of the side walls 20A located below the through holes 32 (adjacent to the sides below the through holes 32). When the lock pieces 46 are further resiliently deformed, the parts of the side walls 20A located below the through holes 32 enter a state supporting the lock pieces 46 by pressing the outer surfaces of the base end parts of the lock pieces 46 inwardly in the width direction. This can adjust an inserting force necessary to resiliently deform the lock pieces 46 to a predetermined magnitude and suppress a movement of the retainer 40 between the partial locking position and the full locking position due to inadvertent resilient deformation of the lock pieces 46.

This embodiment is configured as described above. Next, how to assemble the connector 10 is briefly described and functions and effects of the connector 10 are described.

First, the retainer 40 is fitted into the retainer mounting hole 27 from below the female housing 20 and moved upward relative to the female housing 20. In this process, the lock claws 48 of the lock pieces 46 move onto the partial locking projections 30 and the lock pieces 46 are resiliently deformed outward in the width direction with the base end parts of the lock pieces 46 as support points. Since the lock pieces 46 stand upward from the upper edges of the base bodies 45 and are separated from the retaining portion 41 by the slits 47 at this time, they can be resiliently deformed without interfering with the retaining portion 41.

Specifically, it can be prevented that the lock pieces 46 are resiliently deformed while being inclined in directions different from proper directions as compared with the case where lock pieces and a retaining portion are integrally formed and the lock pieces are resiliently deformed while being widened apart rearward. Further, since the mutual abrasion of the lock pieces 46 and the partial locking projections 30 due to the inclination of the lock pieces 46 can be suppressed, an engaged state of the lock pieces 46 and the partial locking projections 30 can be made stable.

Subsequently, when the lock claws 48 having moved onto the partial locking projections 30 move over the partial locking projections 30, the lock-side locking surfaces 48A of the lock claws 48 are locked by the partial locking surfaces 30A of the partial locking projections 30 from below and the retaining portion 41 is held at the partial locking position as shown in FIG. 4. Further, in this state, the terminal locking portions 44 of the retaining portion 41 are retracted from the cavities 23 and the female terminals 24 can be inserted into and withdrawn from the cavities 23 as shown in FIG. 3.

Then, the female terminal 24 is retained in the cavity 23 by the locking lance 26 by inserting the female terminal 24 connected to the end of the wire W into the cavity 23 up to a proper position from behind.

Figure 10:
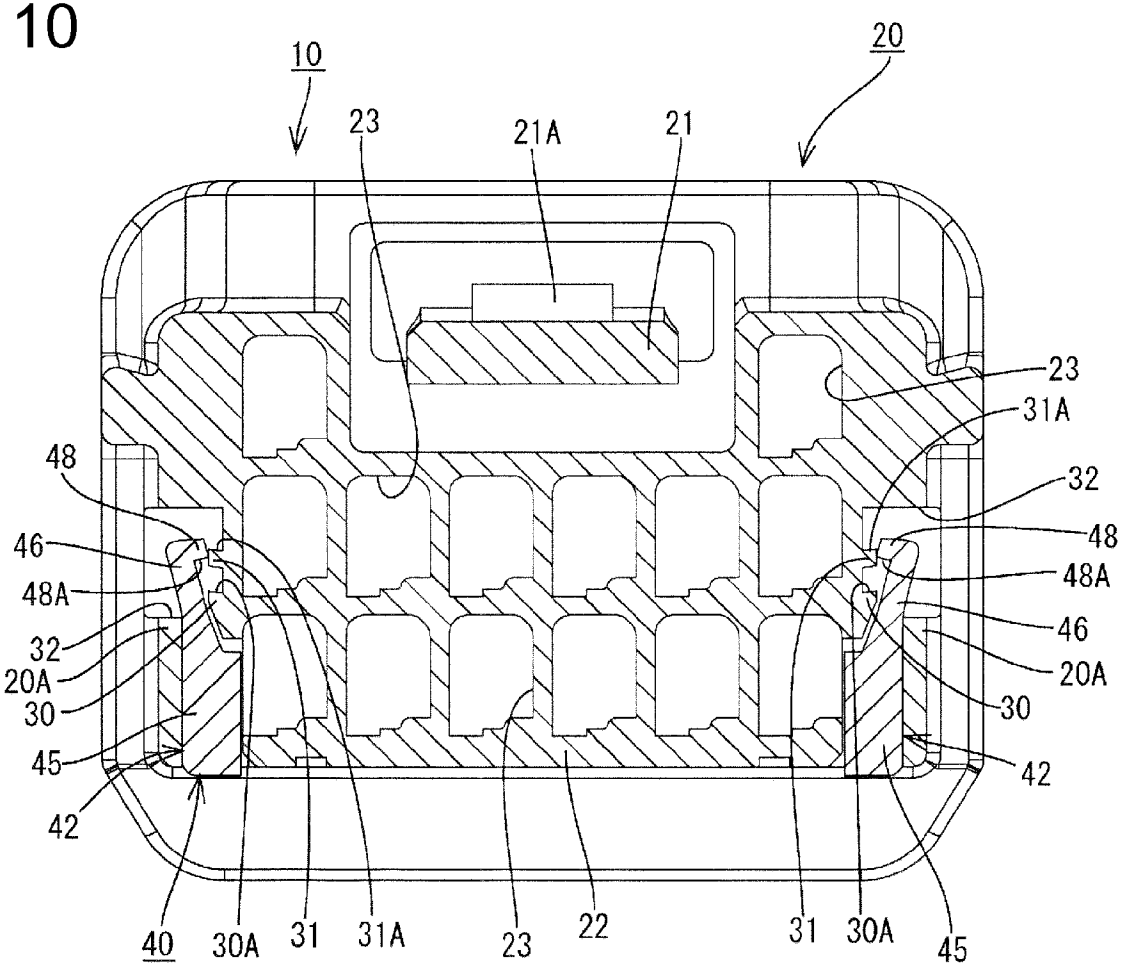
FIG. 10 is a section, corresponding to the section along A-A of FIG. 1, showing a state where the retainer is moved onto full locking projections.

After the female terminal 24 is retained in each cavity 23, the retainer 40 is moved further upward relative to the female housing 20. In this process, the lock claws 48 of the lock pieces 46 move onto the full locking projections 31 and the lock pieces 46 are resiliently deformed outward in the width direction with the base end parts thereof as support points. At this time, the tip parts of the lock pieces 46 are accommodated in the inner spaces of the through holes 32 of the female housing 20 and permitted to be resiliently deformed outward in the width direction as shown in FIG. 10. Further, the lock pieces 46 resiliently deformed outward in the width direction are pressed inwardly in the width direction by the parts of the side walls 20A located below the through holes 32, which can suppress inadvertent resilient deformation of the lock pieces 46 and the settling of the lock pieces 46.

Further, the resilient deformation of the lock pieces 46 in directions different from proper directions can be suppressed as in the case of the partial locking projections 30 also when the lock claws 48 of the lock pieces 46 move onto the partial locking projections 30 and the lock pieces 46 are resiliently deformed.

Figure 9:
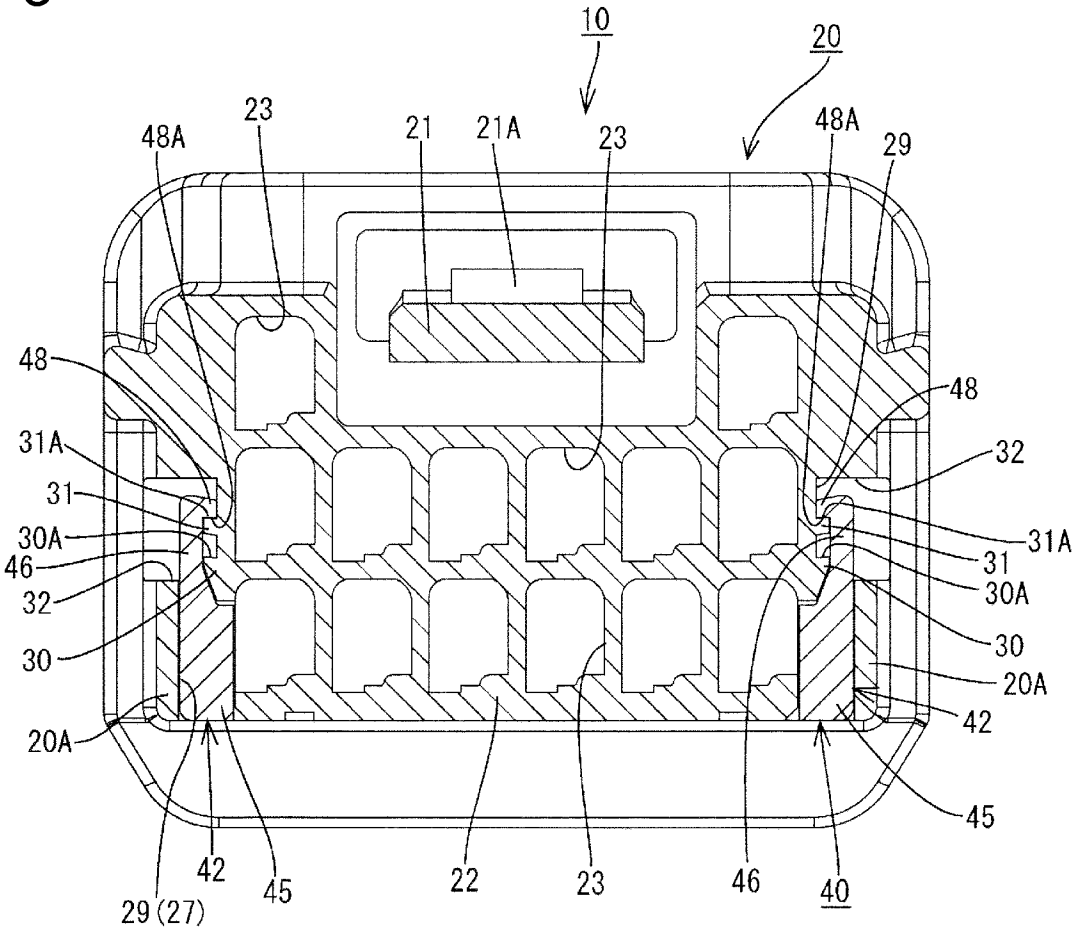
FIG. 9 is a section, corresponding to the section along A-A of FIG. 1, showing the state where the retainer is held at the full locking position in the female housing.

When the lock claws 48 of the lock pieces 46 move over the full locking projections 31, the lock-side locking surfaces 48A thereof are locked by the full locking surfaces 31A of the full locking projections 31 from below as shown in FIG. 9 and the retainer 41 is held at the full locking position as shown in FIG. 8. Further, in this state, the terminal locking portions 44 of the retaining portion 41 project into the cavities 23 as shown in FIG. 8 to retain the female terminals 24 in the cavities 23 by locking the connecting portions 25 of the female terminals 24 from behind. In this way, the female terminals 24 are doubly locked by the locking lances 26 and the terminal locking portions 44.

As described above, since the lock pieces 46 are separated from the retaining portion 41 by the slits 47 according to this embodiment, the lock pieces 46 can be independently resiliently deformed without interfering with the retaining portion 41. This can prevent the lock pieces 46 from being resiliently deformed while being widened in forward and rearward directions, which are different from those in the proper postures, with respect to the partial locking projections 30 and the full locking projections 31 and suppress the mutual abrasion of the lock pieces 46 and the partial and full locking projections 30, 31. Consequently, the engaged states of the lock pieces 46 and the partial and full locking projections 30, 31 can be made stable.

Further, the lock pieces 46 can be easily resiliently deformed to have the proper postures as compared with the case where the retaining portion 41 and the lock pieces 46 are formed in close contact with each other.

The present invention is not limited to the above described and illustrated embodiment. For example, the following embodiments are also included in the technical scope of the present invention.

(1) Although the lock plates 42 are formed behind and adjacent to the retaining portion 41 in the above embodiment, the present invention is not limited to such a mode. For example, lock portions may be formed before a retaining portion.

(2) Although the cavities 23 are arranged side by side in the vertical and width directions in the terminal accommodating portion 22 in the above embodiment, the present invention is not limited to such a mode. For example, cavities may be arranged side by side only in the width direction in a terminal accommodating portion.

(3) Although the slits 47 are formed between the retaining portion 41 and the lock pieces 46 in the above embodiment, the present invention is not limited to such a mode. For example, lock pieces and a retaining portion have only to be separated and the lock pieces and the retaining portion may be formed directly adjacent to each other.

The invention claimed is:

1. A connector, comprising:

a connector housing having at least one cavity penetrating the connector housing in a forward and rearward direction, and a retainer mounting hole formed in the connector housing in retainer mounting direction intersecting the forward and rearward direction, and at least one lock portion formed in the retainer mounting hole;

at least one terminal fitting inserted in the at least one cavity; and a retainer mountable into the retainer mounting hole of the connector housing, wherein the retainer includes:

a retaining portion having at least one terminal insertion hole which retains the at least one terminal fitting when the retainer is inserted into the retainer mounting hole; and first and second lock plates projecting rearward from opposite widthwise ends of the retaining portion, the first and second lock plates each including a base body extending rearward from the retaining portion and a lock piece standing up from the base plate in the retainer mounting direction and reinforcing portions provided on lateral edge parts of the lock pieces; and first and second slits formed respectively between the lock pieces of the first and second lock plates and the retaining portion in the forward and rearward direction, wherein the lock pieces of the first and second lock plates are resiliently deformed relative to the base body when moved onto the at least one lock portion and resiliently restored to be engaged with the at least one lock portion.

2. The connector of claim 1, wherein the retainer mounting hole is formed in a bottom surface of the connector housing and is substantially U-shaped.

3. The connector of claim 1, further comprising lock claws formed on the lock pieces of the first and second lock plates and configured for engaging the at least one lock portion.

4. The connector of claim 3, wherein the reinforcing portions are formed integrally with the lock claws.

5. The connector of claim 1, wherein the reinforcing portions of are formed on the lock pieces at inwardly facing positions.

6. The connector of claim 1, wherein the at least one lock portion comprises a pair of partial lock portions configured to engage the lock pieces when the retainer is at a partial locking position, and a pair of full lock portions configured to engage the lock pieces when the retainer is at a full locking position.

* * * * *